US008616993B2

(12) United States Patent
Bittner

(10) Patent No.: US 8,616,993 B2
(45) Date of Patent: Dec. 31, 2013

(54) PUTTER PATH DETECTION AND ANALYSIS

(71) Applicant: Norman Douglas Bittner, ST. Helena Island, SC (US)

(72) Inventor: Norman Douglas Bittner, ST. Helena Island, SC (US)

( * ) Notice: Subject to any disclaimer, the term of this patent is extended or adjusted under 35 U.S.C. 154(b) by 0 days.

(21) Appl. No.: 13/901,717

(22) Filed: May 24, 2013

(65) Prior Publication Data

US 2013/0252751 A1 Sep. 26, 2013

Related U.S. Application Data

(60) Continuation-in-part of application No. 13/680,833, filed on Nov. 19, 2012, now Pat. No. 8,579,720, which is a continuation-in-part of application No. 13/404,387, filed on Feb. 24, 2012, now Pat. No. 8,337,321, which is a continuation-in-part of application No. 13/210,741, filed on Aug. 16, 2011, now Pat. No. 8,177,656, and a continuation-in-part of application No. 13/182,722, filed on Jul. 14, 2011, now Pat. No. 8,152,649, which is a division of application No. 12/268,231, filed on Nov. 10, 2008, now Pat. No. 8,002,643, said application No. 13/210,741 is a division of application No. 12/974,721, filed on Dec. 21, 2010, now Pat. No. 8,047,928, which is a continuation-in-part of application No. 12/268,231, filed on Nov. 10, 2008, now Pat. No. 8,002,643.

(60) Provisional application No. 61/652,499, filed on May 29, 2012, provisional application No. 61/750,992, filed on Jan. 10, 2013, provisional application No. 61/449,112, filed on Mar. 4, 2011, provisional application No. 61/500,166, filed on Jun. 23, 2011, provisional application No. 61/524,079, filed on Aug. 16, 2011.

(51) Int. Cl.
*A63B 69/36* (2006.01)

(52) U.S. Cl.
USPC ..... 473/265; 473/226; 473/409

(58) Field of Classification Search
USPC ..... 473/202, 206, 219–226, 231–234, 252, 473/257, 261, 262, 266, 409
See application file for complete search history.

(56) References Cited

U.S. PATENT DOCUMENTS

| | | | | |
|---|---|---|---|---|
| 2,090,348 | A | | 8/1937 | Ferry |
| 2,995,376 | A | | 8/1961 | Leo |
| 3,311,377 | A | | 3/1967 | Holbus |
| 3,687,459 | A | | 8/1972 | Swords |
| 3,885,796 | A | | 5/1975 | King |
| 3,945,646 | A | | 3/1976 | Hammond |
| 3,992,013 | A | | 11/1976 | Golden |
| 4,088,324 | A | * | 5/1978 | Farmer ..... 473/223 |
| 4,137,566 | A | | 1/1979 | Haas et al. |
| 4,155,555 | A | | 5/1979 | Fink |
| 4,251,077 | A | | 2/1981 | Pelz et al. |
| 4,254,956 | A | | 3/1981 | Rusnak |
| 4,304,406 | A | | 12/1981 | Cromarty |
| 4,341,384 | A | | 7/1982 | Thackrey |
| 4,535,992 | A | | 8/1985 | Slagle |
| 4,615,526 | A | | 10/1986 | Yasuda et al. |

(Continued)

*Primary Examiner* — Nini Legesse
(74) *Attorney, Agent, or Firm* — Nixon & Vanderhye P.C.

(57) ABSTRACT

A putting stroke sensor assembly is cooperable with a putter head. The putting stroke sensor assembly includes a processor, a memory storing a preferred putting path, and an accelerometer configured to measure characteristics of a putting stroke. The processor is programmed to compare the characteristics of the putting stroke with the preferred putting path and to generate an output indicative of the comparison.

20 Claims, 11 Drawing Sheets

(56) References Cited

U.S. PATENT DOCUMENTS

| | | | | |
|---|---|---|---|---|
| 4,858,934 | A * | 8/1989 | Ladick et al. | 473/220 |
| 4,958,836 | A | 9/1990 | Onozuka et al. | |
| 4,962,931 | A | 10/1990 | Jazdzyk, Jr. | |
| 4,971,325 | A | 11/1990 | Lipps | |
| 4,979,745 | A | 12/1990 | Kobayashi | |
| 5,020,802 | A | 6/1991 | af Strom | |
| 5,131,660 | A * | 7/1992 | Marocco | 473/220 |
| 5,282,627 | A | 2/1994 | Beck | |
| 5,374,063 | A | 12/1994 | Ogden | |
| 5,393,065 | A | 2/1995 | LeQuyea | |
| 5,419,562 | A | 5/1995 | Cromarty | |
| 5,435,547 | A | 7/1995 | Lee | |
| 5,492,329 | A | 2/1996 | Kronin | |
| 5,501,463 | A | 3/1996 | Gobush et al. | |
| 5,614,823 | A | 3/1997 | Katayama et al. | |
| 5,638,300 | A | 6/1997 | Johnson | |
| 5,685,782 | A | 11/1997 | Lipps et al. | |
| 5,907,819 | A | 5/1999 | Johnson | |
| 6,027,417 | A | 2/2000 | Zoretic et al. | |
| 6,095,928 | A | 8/2000 | Goszyk | |
| 6,224,493 | B1 * | 5/2001 | Lee et al. | 473/223 |
| 6,287,215 | B1 | 9/2001 | Fisher | |
| 6,361,449 | B1 | 3/2002 | Holly | |
| 6,375,579 | B1 | 4/2002 | Hart | |
| 6,669,574 | B1 | 12/2003 | Riley et al. | |
| 6,739,981 | B1 | 5/2004 | Lin | |
| 6,821,211 | B2 * | 11/2004 | Otten et al. | 473/219 |
| 6,849,001 | B2 | 2/2005 | Simpson | |
| 6,875,120 | B1 | 4/2005 | Ellis | |
| 6,913,544 | B2 | 7/2005 | Tiffin | |
| 6,991,552 | B2 * | 1/2006 | Burke | 473/213 |
| 7,232,375 | B1 | 6/2007 | Robert et al. | |
| 7,824,276 | B2 | 11/2010 | Simpson | |
| 7,955,180 | B2 | 6/2011 | Bittner | |
| 8,002,643 | B2 | 8/2011 | Bittner | |
| 8,047,928 | B2 | 11/2011 | Bittner | |
| 8,152,649 | B2 | 4/2012 | Bittner | |
| 8,177,656 | B2 | 5/2012 | Bittner | |
| 8,257,191 | B2 | 9/2012 | Stites et al. | |
| 2001/0005695 | A1 | 6/2001 | Lee et al. | |
| 2002/0077189 | A1 * | 6/2002 | Tuer et al. | 473/151 |
| 2003/0144088 | A1 * | 7/2003 | Shoane | 473/405 |
| 2003/0203762 | A1 * | 10/2003 | Ross | 473/151 |
| 2003/0207718 | A1 * | 11/2003 | Perlmutter | 473/221 |
| 2004/0014531 | A1 * | 1/2004 | Ziener-Gundersen | 473/222 |
| 2004/0106092 | A1 | 6/2004 | Galanis et al. | |
| 2004/0259651 | A1 * | 12/2004 | Storek | 473/131 |
| 2005/0020369 | A1 * | 1/2005 | Davis et al. | 473/131 |
| 2005/0197198 | A1 | 9/2005 | Otten et al. | |
| 2005/0202893 | A1 | 9/2005 | Otten et al. | |
| 2005/0261073 | A1 | 11/2005 | Farrington, Jr. et al. | |
| 2006/0029916 | A1 | 2/2006 | Boscha | |
| 2006/0166738 | A1 * | 7/2006 | Eyestone et al. | 463/36 |
| 2007/0249428 | A1 | 10/2007 | Pendleton et al. | |
| 2008/0242437 | A1 | 10/2008 | Taylor | |
| 2009/0163285 | A1 | 6/2009 | Kwon et al. | |
| 2010/0306685 | A1 | 12/2010 | Giaimo, III et al. | |
| 2011/0086720 | A1 | 4/2011 | Jaekel et al. | |
| 2012/0289354 | A1 | 11/2012 | Cottam et al. | |
| 2012/0295726 | A1 * | 11/2012 | Cherbini | 473/222 |
| 2012/0322569 | A1 | 12/2012 | Cottam | |
| 2012/0329568 | A1 | 12/2012 | Stites et al. | |

* cited by examiner

PUTTER PATH DETECTION AND ANALYSIS

CROSS-REFERENCES TO RELATED APPLICATIONS

This application claims the benefit of U.S. Provisional Patent Application Ser. No. 61/652,499, filed May 29, 2012, and U.S. Provisional Patent Application Ser. No. 61/750,992, filed Jan. 10, 2013, the entire content of each of which is herein incorporated by reference.

This application is also a continuation-in-part (CIP) of U.S. patent application Ser. No. 13/680,833, filed Nov. 19, 2012, pending, which is a continuation-in-part (CIP) of U.S. patent application Ser. No. 13/404,387, filed Feb. 24, 2012, now U.S. Pat. No. 8,337,321, and claims the benefit of U.S. Provisional Patent Application No. 61/652,499, filed May 29, 2012, the entire contents of each of which are herein incorporated by reference.

U.S. patent application Ser. No. 13/404,387 claims the benefit of U.S. Provisional Patent Application No. 61/449,112, filed Mar. 4, 2011, U.S. Provisional Patent Application No. 61/500,166, filed Jun. 23, 2011, and U.S. Provisional Patent Application No. 61/524,079, filed Aug. 16, 2011, the entire contents of each of which are herein incorporated by reference.

U.S. patent application Ser. No. 13/404,387 is also a continuation-in-part (CIP) of U.S. patent application Ser. No. 13/182,722, filed Jul. 14, 2011, now U.S. Pat. No. 8,152,649, and a continuation-in-part (CIP) of U.S. patent application Ser. No. 13/210,741, filed Aug. 16, 2011, now U.S. Pat. No. 8,177,656, the entire contents of each of which are hereby incorporated by reference in this application.

U.S. patent application Ser. No. 13/182,722 is a divisional of U.S. patent application Ser. No. 12/268,231, filed Nov. 10, 2008, now U.S. Pat. No. 8,002,643, the entire contents of which are hereby incorporated by reference in this application.

U.S. patent application Ser. No. 13/210,741 is a divisional of U.S. patent application Ser. No. 12/974,721, filed Dec. 21, 2010, now U.S. Pat. No. 8,047,928; which is a continuation-in-part of U.S. patent application Ser. No. 12/268,231, filed Nov. 10, 2008, now U.S. Pat. No. 8,002,643, the entire contents of each of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The invention relates generally to a device and method for training and analysis of a putting stroke and, more particularly, to a component of a putting stroke training system that enables a golfer to analyze putting strokes made away from a training device.

For a golfer to be a good putter, the golfer must be able to control distance and direction with a putter. The golfer must also possess skills for "reading" a green. When "reading" a green, the golfer analyzes the terrain between the ball and the hole and determines the extent to which the ball will curve or "break" during the putt.

Golfers typically putt with a pendulum type swing using a shoulder turn. Other putting styles are also used, sometimes depending on the type and/or size of the putter or golfer. Regardless of the particular style used, it is critical to a successful putt that the golfer be capable of making a consistent stroke.

In the noted family of inventions from which this application claims priority, structure and methods are described to assist a golfer in identifying a preferred putting path. It is recognized that there is not one "perfect" path for all golfers with regard to a putting stroke, particularly with amateur golfers, but rather there is a preferred path for each individual golfer that gives that golfer the best chance for a successful putt. The system and methods in the noted family of patents and applications facilitate the identification of the golfer's preferred putting path and provide vehicles to assist the golfer in putting consistently on the preferred path.

To determine the preferred putting path, touch sensitive or proximity sensitive computer screens and the like along with sensors on the putter itself are used to determine a golfer's preferred putting path, i.e., a path for the golfer that is most likely to achieve a successful result. Once the preferred path is determined, the path can be marked or displayed on a grid box floor, which the golfer can take to the practice putting green. In an exemplary application, a clear plastic tracing material can record the path of the lines on the computer screen for transfer to the grid box floor. Additional features of the invention family may include sensors and alarms cooperable with the grid box that signal when the golfer deviates from the preferred putting path during a putt. The grid box may also be provided with a flexible wall that can be positioned in alignment with the preferred putting path marked on the grid box floor to guide the golfer in following the preferred putting path and to develop muscle memory.

BRIEF SUMMARY OF THE INVENTION

Research has pointed out a fundamental misunderstanding of how a golfer should go about practicing putting. What has been happening traditionally is that a golfer repeatedly practices a putting stroke aiming at a cup, for example, some distance away. Some balls go in but about half just miss by a hair. The golfer does not know why. There is no benchmark or record for the stroke or the speed of the putter head. This is known in science as random behavior producing results from some unknown origin.

It is possible in present versions of software and touch and near-touch screen technology to trace on a computer screen the path of a putting stroke. The putting motion must be consistent to ensure predictability of the putt. It does not matter to the golf ball if it has been stroked with a pendulum swing or a linear path motion. It is the replication of a grooved stroke that is important to produce contact with the ball consistently. The practice and training tool of the described embodiments enables a golfer to learn and practice a successful and repeatable putting stroke.

Once a golfer has recorded a preferred putting path that is unique to that golfer, it would be desirable for the golfer to be able to review putting strokes taken away from the analyzing/training system so that the golfer can measure improvements in performance or otherwise understand what areas in the golf stroke require additional training.

In an exemplary embodiment, a putting stroke sensor assembly is cooperable with a putter head. The putting stroke sensor assembly includes a processor, a memory storing a preferred putting path, and an accelerometer configured to measure characteristics of a putting stroke. The processor is programmed to compare the characteristics of the putting stroke with the preferred putting path and to generate an output indicative of the comparison.

The assembly may further include a display communicating with the processor, where the processor drives the display according to the output. The display may be positioned on a handle attached to the putter head and/or on an upward facing surface of the putter head. In one arrangement, the display includes a plurality of LEDs arranged to convey information about the putting stroke. A clubface position section of the LEDs may include the LEDs arranged in an arc, where the processor is programmed to cause center ones of the arc to illuminate if the putter face is square to a putting direction at impact, and to cause outer ones of the arc to illuminate if the putter face is rotated relative to the putting direction. A speed section of the LEDs may include the LEDs arranged in a line in alignment with the putting direction, where the processor is programmed to illuminate different ones of the line depending on a speed of the putter head.

The characteristics of the putting stroke may include speed, acceleration, putter head position, putter head path, putter head rotation, and putter head tilt. In this context, the assembly may include a plurality of accelerometers.

The processor may be programmed to operate in a learning mode in which the processor interactively communicates with a user to measure the preferred putting path.

The assembly may additionally include a battery, which may be positioned in a handle attached to the putter head.

Additionally, the assembly may include a user interface in communication with the processor.

In another exemplary embodiment, a method for analyzing a putting stroke using a stroke sensor assembly includes the steps of storing a preferred putting path in the memory; measuring characteristics of a putting stroke with the accelerometer; comparing, with the processor, the characteristics of the putting stroke with the preferred putting path; and generating an output indicative of the comparison.

The storing step may be practiced by interactively communicating with a user to measure the preferred putting path.

The method may also include displaying an image that represents the output. The displaying step may include displaying the image on a handle attached to the putter head and/or displaying the image on an upward facing surface of the putter head.

The measuring step may include measuring speed, acceleration, putter head position, putter head path, putter head rotation, and putter head tilt. The measuring step may be practiced for each putt during a round of golf, where the comparing step includes comparing each putting stroke in the round of golf with the preferred putting path.

In yet another exemplary embodiment, a putting stroke sensor assembly includes a processor, a memory communicating with the processor, and an accelerometer communicating with the processor. The accelerometer is configured to measure characteristics of a putting stroke. The processor is programmed to operate in a learning mode in which the processor interactively communicates with a user to measure a preferred putting path that is unique to the user. The memory stores the preferred putting path. The processor is further programmed to compare the characteristics of the putting stroke with the preferred putting path and to generate an output indicative of the comparison.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
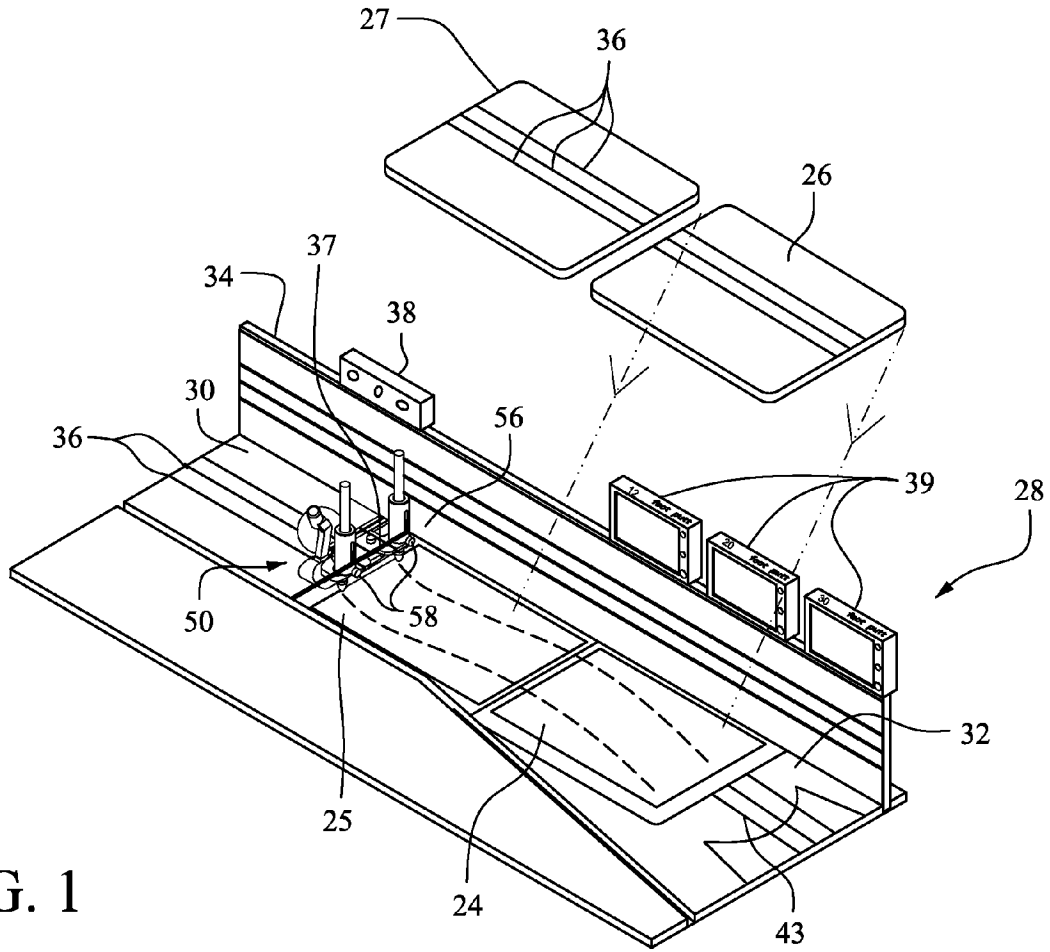
FIG. 1 is a perspective view of the training and practice tool assembled in the form of a grid box.

With reference to FIG. 1, a training and practice tool is assembled in the form of a grid box 28, which is portable and easily positioned for use by a golfer. The grid box 28 includes a bottom 32 and at least one side 34 as shown. Openings or blanks are provided in the bottom 32 to accommodate one and preferably two computers 24, 25 (such as an iPad available from Apple, Inc., or other tablet computer, or screen technology available from Perceptive Pixel by Microsoft—www.perceptivepixel.com). The computers 24, 25 are positioned in the blanks such that a top surface of the computers is flush and continuous with the surface of the bottom 32 facing the golfer. The system also includes inserts 26, 27 that match the profile of the computers 24, 25 in the event that the golfer elects to use the grid box 28 without the computers 24, 25.

The bottom 32 is also provided with alignment lines 36 that can match corresponding lines 37 on an attachment secured to a putter head 50. The inserts 26, 27 include corresponding lines 36. The lines 36 in the grid box 28 and the lines 37 on the putter head 50 assist the golfer in assessing a position of the putter head 50 during the putting stroke and particularly at impact with the ball.

Preferably, the grid box 28 includes a protractor 43 at the putting end. The protractor 43 may be attached in the opposite orientation. Additionally, the grid box 28 may include one or both of a side-to-side level and a front-to-back level 38, which show an orientation of the grid box 28 on the green.

The levels 38 can be analog or digital, and a single level could be used to measure an orientation of the grid box in two dimensions. An analog or digital level could also be put on a swivel so it can show both longitudinal and side-to-side inclinations of the putting green. The positions of the two readings can be related to the protractor 43. It may read, for example, 4° downward slope and 2° side hill slope. An index can be established that will determine the compensation in aiming the grid box 28. The index is representative of a variation in degrees from the norm of a straight putt on a flat surface. The resulting arithmetical reading on the protractor can indicate how much the grid box 28 should be repositioned in aim to compensate for the trajectory that the ball is going to have to travel in its path to the cup. Measurements of this type can lead to training a golfer to read greens with a higher percentage of accuracy. After a number of test putts, it can be determined if putter head is being kept on the preferred path, after which deviations in green reading accuracy can be determined.

The grid box 28 may still also include one or more metronomes 39, which provide an audible and visual rhythm for the putting stroke. As shown, the grid box 28 may be provided with three metronomes 39 with specific settings for putt lengths of 12, 20 and 30 feet, respectively.

The putter head 50 is fitted with a scriber attachment 56 including one or more marking members 58 that are detectable by the computers 24, 25. The computers 24, 25 can run a program that detects and displays the marking members 58 and possibly also the ball to provide a visual indication of the putter stroke back swing, impact position, and follow through. The computers 24, 25 can also illustrate a path of the ball after being struck by the putter head 50. The program can distinguish between the golfer's back swing and forward swing by displaying a different color depending on the motion direction of the putter head.

In use, after aiming the grid box, a golfer can place a ball between the computers 24, 25. As the golfer draws the putter head 50 back, the back swing computer 24 records and displays initial back swing and beginning forward stroke of the putter head by sensing the marking instruments 58. After impact with the ball, the follow through computer 25 measures both the follow through path of the putter head by sensing a position of the marking elements 58 and a path of the ball. The stroke path and impact position are critical in determining a path of the ball after being struck by the putter.

Figure 2:
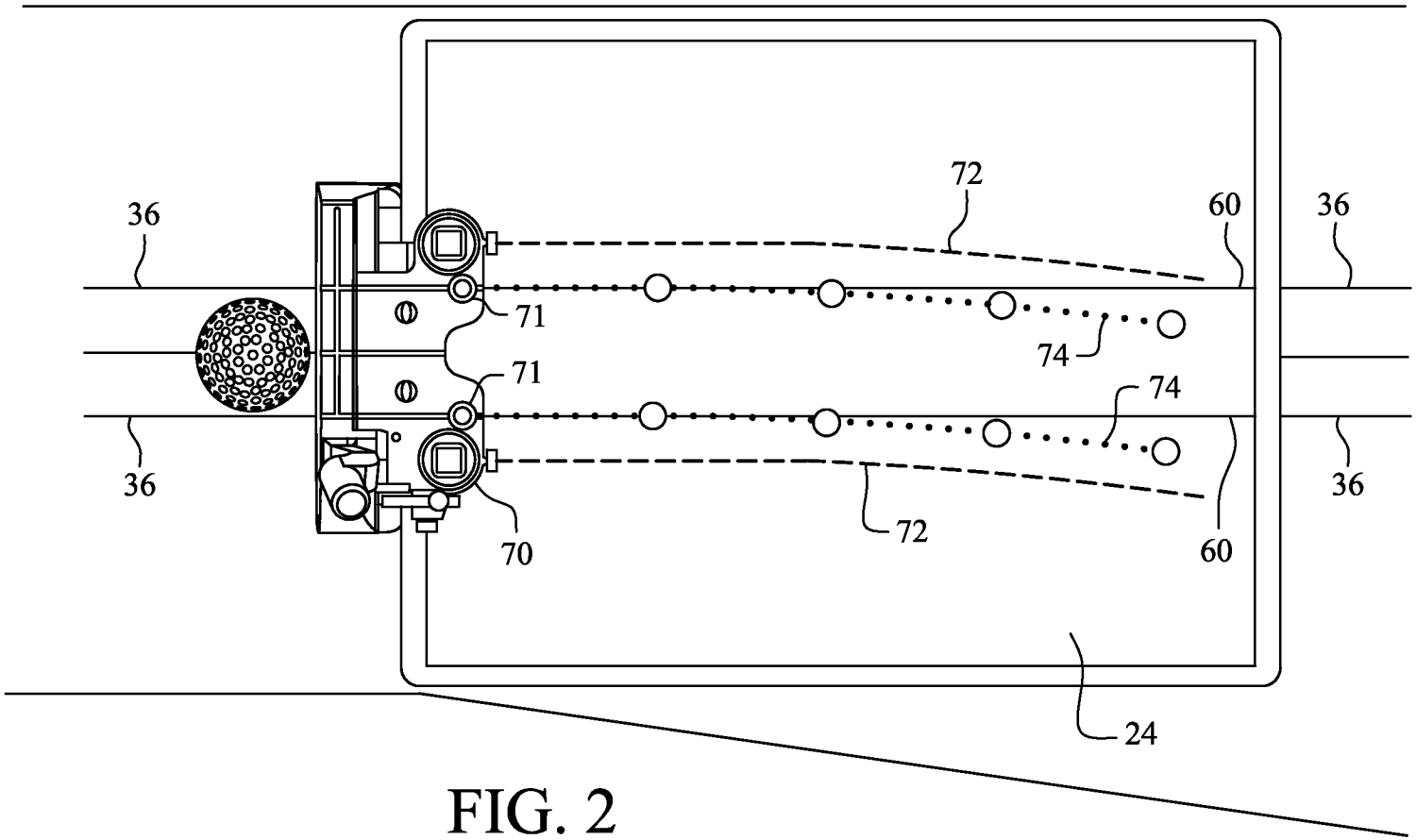
FIG. 2 shows an exemplary recorded putting path.
Figure 3A:
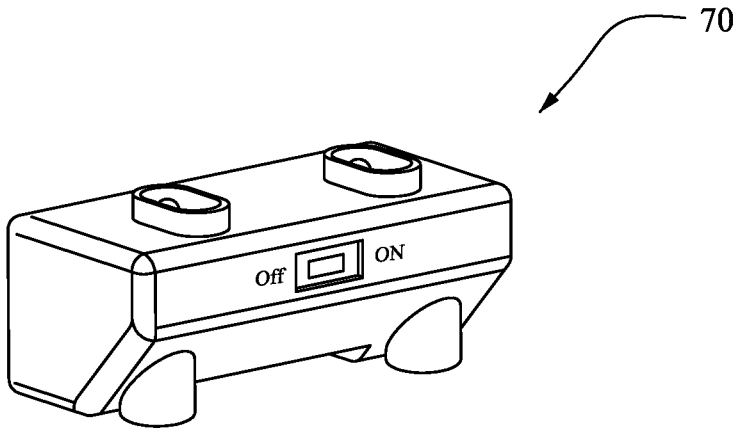
FIGS. 3A and 3B show an exemplary putting sensor unit.
Figure 3B:
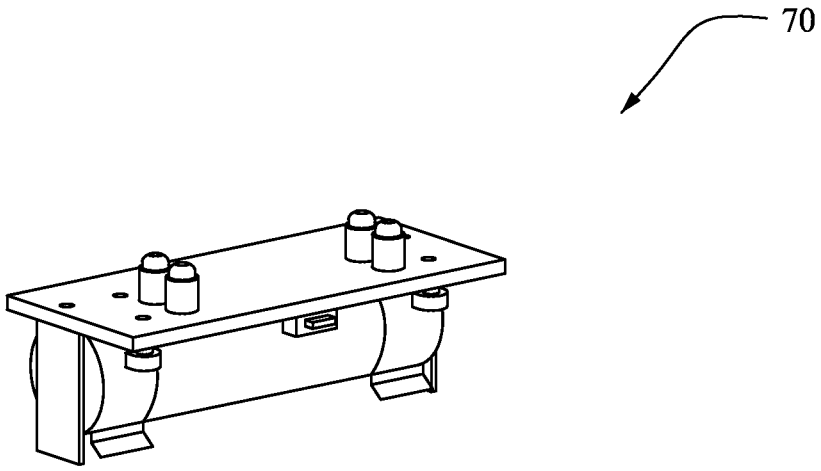
Figure 4A:
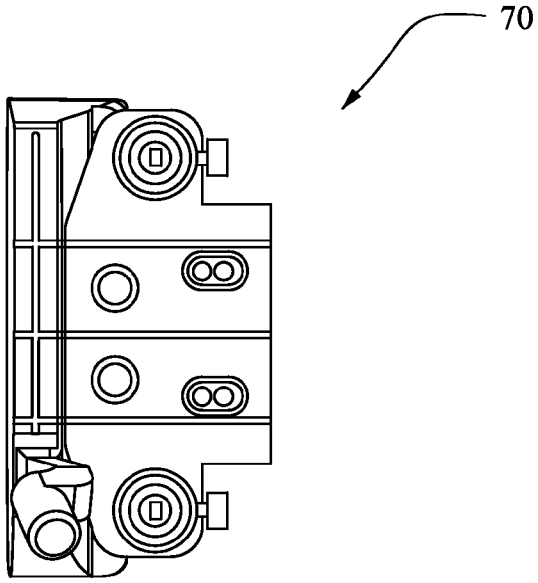
FIGS. 4A and 4B show the exemplary sensor unit attached to a putter head.
Figure 4B:
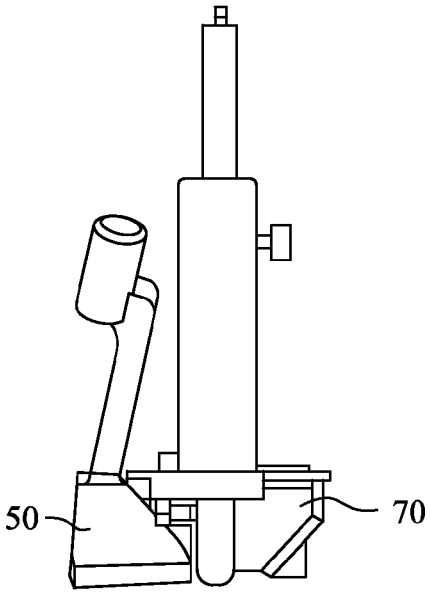
Figure 5:
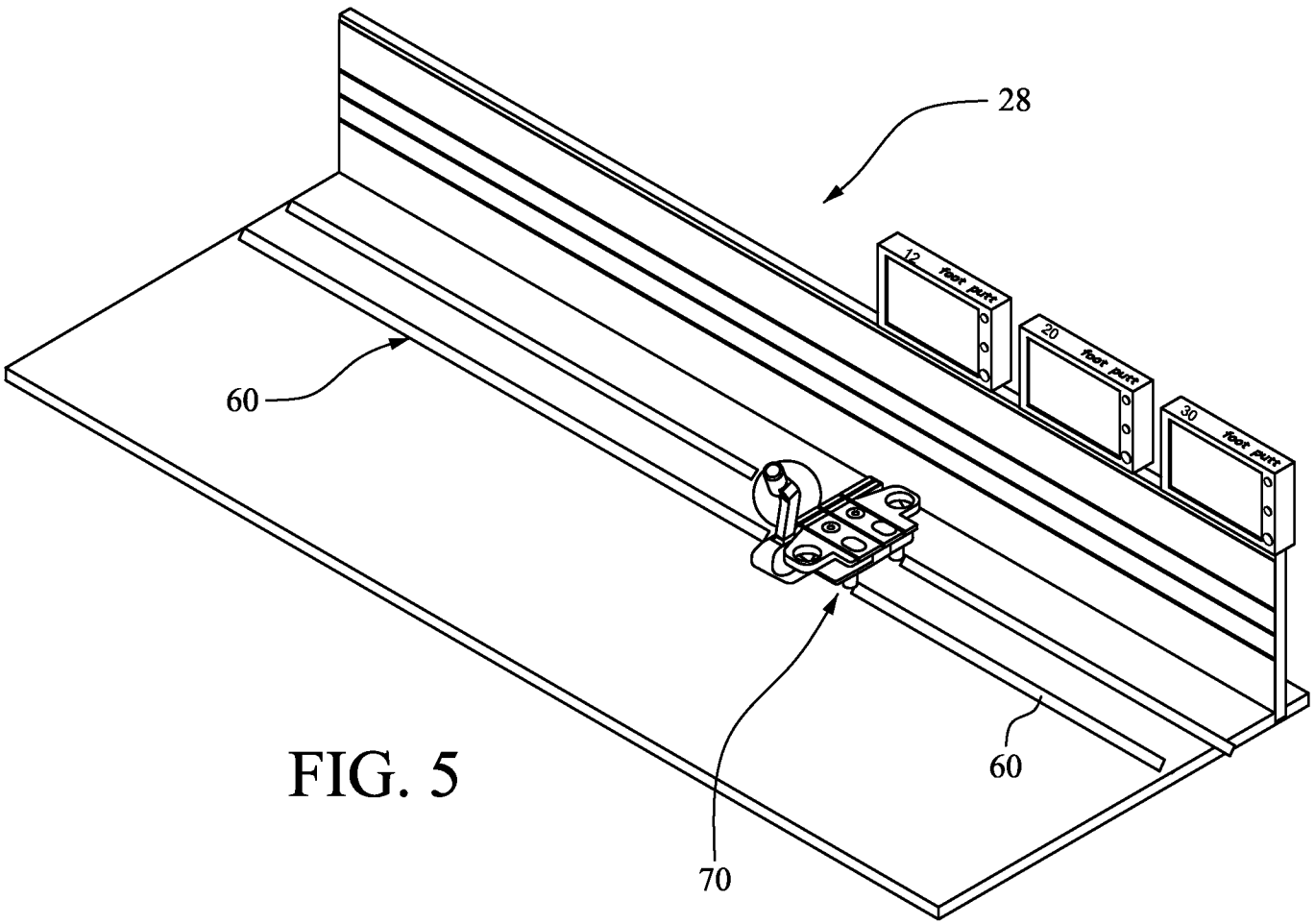
FIG. 5 is a perspective view of a variation on the training and practice tool.
Figure 6:
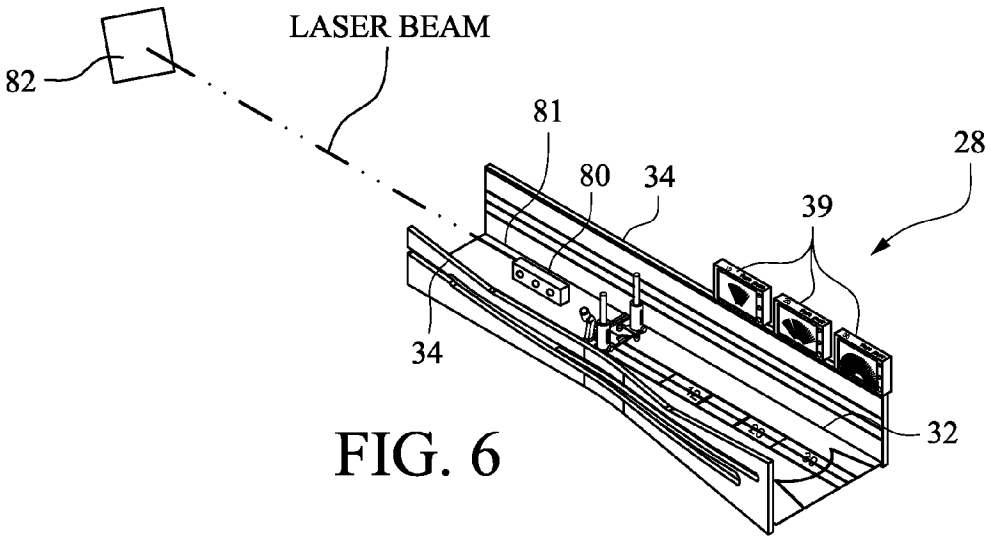
FIGS. 6-9 show an application of the training tool.

FIGS. 2-5 show an additional feature that may be included as part of the grid box device. As shown in FIG. 2, sensor strips 60 may be secured to the computers 24, 25 preferably in alignment with the outermost grid lines 36 on the bottom surface of the grid box. The sensor strips 60 may be formed of any suitable construction including, for example, a metallic tape. The putter head 50 may be provided with corresponding sensors on a bottom surface. Alternatively, a sensor unit 70 may be secured to the putter head 50. Details of an exemplary sensor unit 70 are shown in FIGS. 3A and 3B, and FIGS. 4A and 4B show top and side views, respectively, of a putter head 50 with the sensor unit 70 attached. In still another variation, the marking members 58 in the scriber attachment 56 can be replaced with a sensor and include an indicator light 71 on a top facing the golfer, or the sensor can accommodate the marking members (see FIG. 2). The sensors interact with the sensor strips 60, and a signal such as an LED light 71 or the like may be illuminated on the top of the putter head or sensor unit or sensor scriber when the sensors are in alignment with the sensor strips 60. The signal indicator may light one color (e.g., white) when the sensors are aligned and a different color (e.g., red) when sensors are not aligned. FIG. 5 shows an economical variation with the sensor strips 60 applied in a grid box 28 without the computers 24, 25 or blanks 26, 27.

In use, the sensor strips 60 on the screen must be followed during putting. In order to putt successfully, both white diodes must be on. If one is red, the club is twisted. If both are red, the golfer has gone off track. As the ball is struck, both diode lights 71 have to be white in order to send the ball in the direction the grid box 28 has been aimed; i.e., having a square face to the ball relative to the target. This feature provides an additional indicator to the golfer to assist the golfer in aligning the putter head in a proper orientation, particularly at impact. In FIG. 2, a path 72 of the marking instruments is shown in dashed line, and a path 74 followed by the sensors of the sensor unit 70 and the LEDs 71 is shown in dotted line.

The sensor unit 70 preferably runs by chip and battery. As the putter head traces in the drawback along the line defined by the sensor strips 60, the RED and WHITE LED will light up depending on sensor alignment.

In a variation of this concept, the sensor strips 60 may be curved to accommodate a more pendulum-type swing. The curvature may be predetermined based on a typical putting stroke path of the particular user. A template can be generated so that the strips 60 can be properly placed. After recording a pre-set number of successful putting strokes, a preferred path can be printed on a gradient sheet that is placed on the bottom of the grid box. The preferred path can be replicated with the sensor strips 60. As noted above, it is not necessary that the putter head maintain alignment during the entire putting stroke, but rather the putter head should be aligned at impact. In still another variation, the sensor strips 60 may be wider to accommodate a non-linear putting stroke. In this context, the sensor strips 60 may be tapered such that the strips are narrowest at the impact position and wider through the back swing and follow through of the putting stroke also to accommodate a pendulum or other non-linear putting stroke.

The sensor strips 60 would not affect the recording of the putting stroke on the computers.

Figure 7:
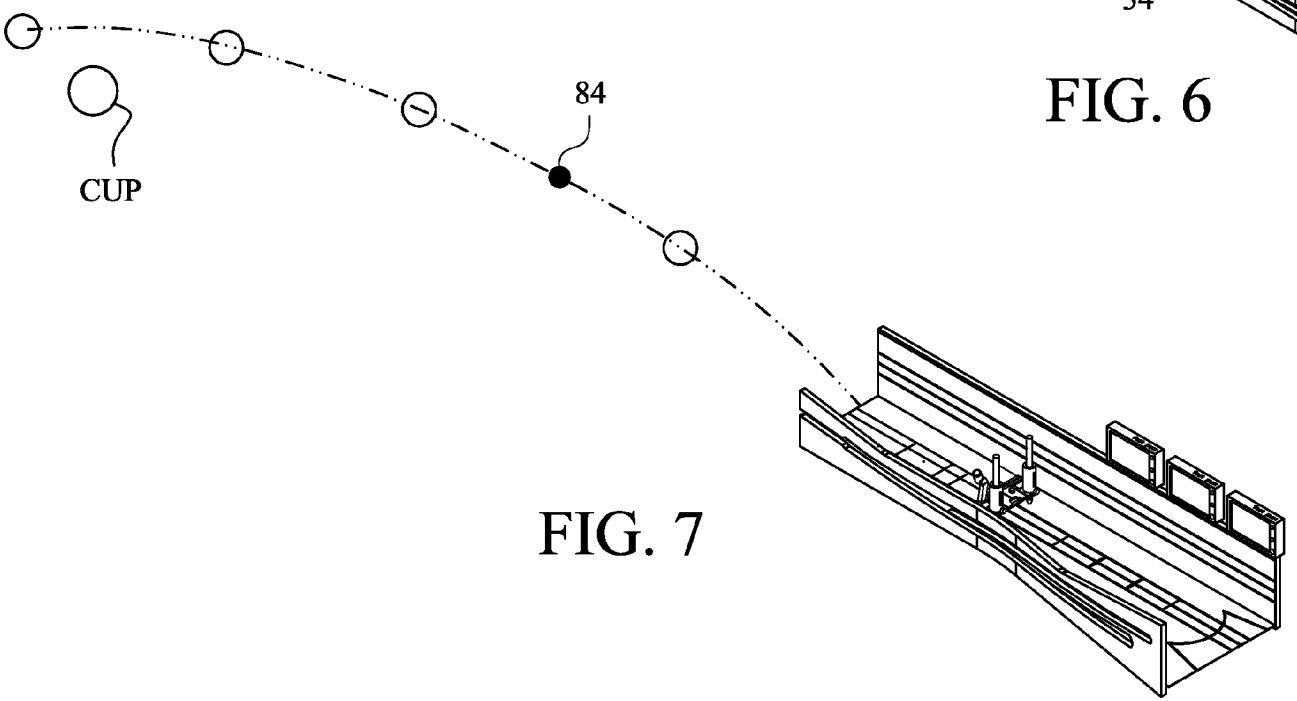
Figure 8:
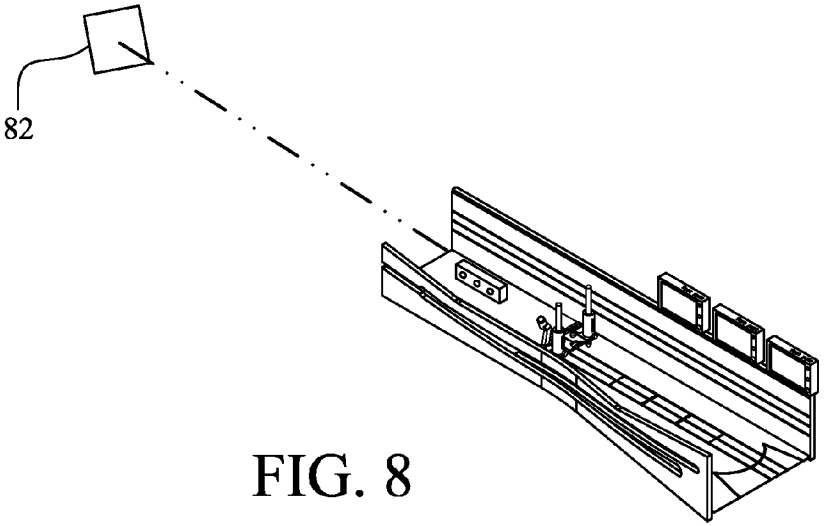
Figure 9:
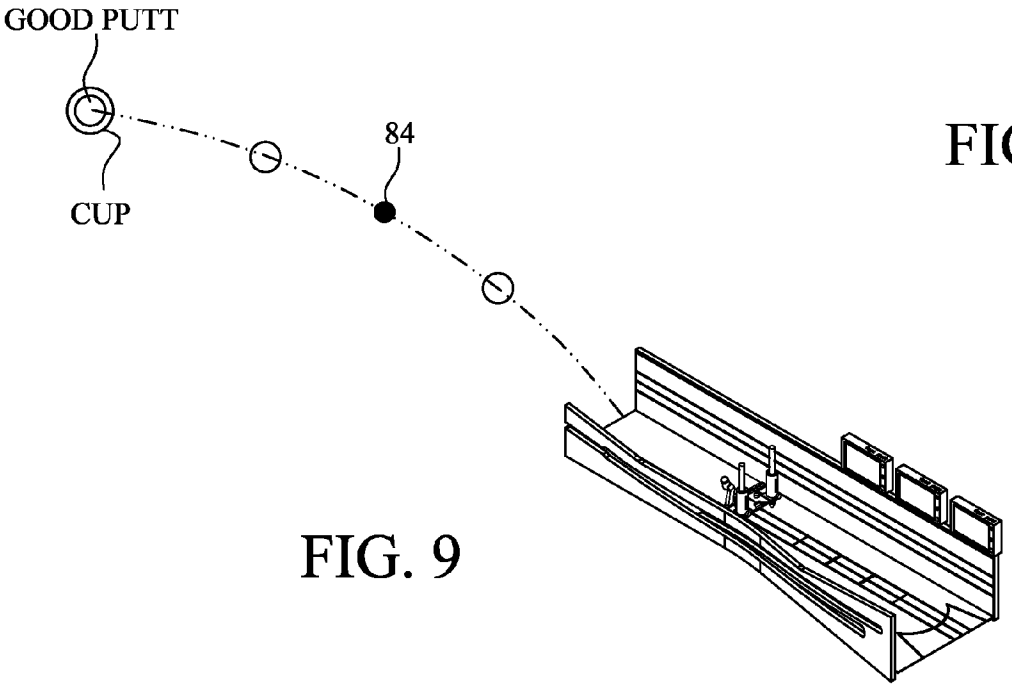

FIGS. 6-9 show an application of the economical grid box (i.e., without the computers 24, 25) on a sloped green, using a laser aiming device 80. The aiming device 80 can be used in conjunction with the computers 24, 25 as well. The sensor strips 60 may also be placed on a Plexiglass insert that can be easily removed and portable to be taken with the golfer for practice and training. The golfer aims the grid box 28 in alignment with the intended putt direction, and using a target 82 that is illuminated by a laser beam 81 emitted from the laser 80, a ball marker 84 is placed on the green. In FIG. 7, the golfer attempts a putt in the direction of the ball marker 84. If the golfer determines that the putt was missed because the grid box is misaligned (i.e., the grid box does not accurately account for the amount of break in the putt), the golfer re-aligns the grid box and re-sets the ball marker (FIG. 8). This process is repeated until the grid box is properly aligned, and a successful putt is achieved (FIG. 9). By these iterations, the grid box can be used essentially as a green reading device or "Green Reading Machine."

The grid box enables the golfer to record/document errors and make alterations and corrections in the mind's eye and muscle behavior when practicing putting strokes. The recorded tracings delineate and explain the correlation between the aberrations in stroke and misjudgments in aim. Any other futile attempt to retry to sink putts randomly is counterproductive and arbitrarily doomed to failure without the use of benchmarks, guidelines and recording devices.

Without record keeping for a series of successful putts, it could still be a mystery why success or failure occurred. Going back on a subsequent day and not repeating success would be even more frustrating because there would be no explanation of why success occurred on one day and not on another. Frustrated golfers are infamous for their explanations of why one day they were so good and others so terrible. Recordings on an ongoing basis, using the guidelines on the club coordinated with the grid box guidelines, provide a means to produce a consistent outcome for successful putting because eventually muscle memory, rhythm, distance judgment and other factors will become a habit.

Figures 10, 11:
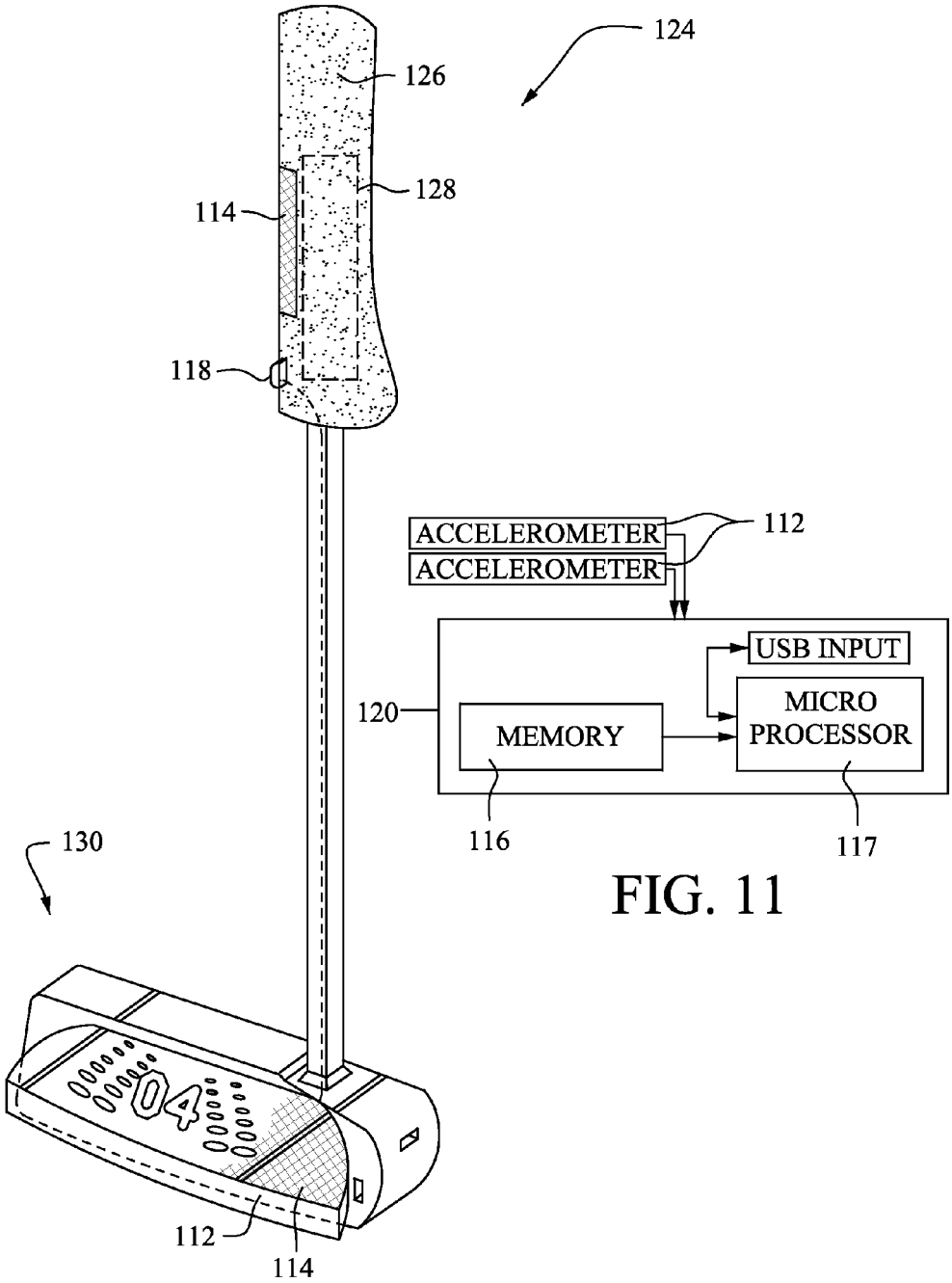
FIG. 10 shows a putter stroke analysis system.
FIG. 11 is a schematic diagram of the system hardware.

FIGS. 10-14 illustrate an application where a putting stroke can be analyzed during the course of play with reference to the preferred putting path and without the grid box described above. With reference to FIGS. 10 and 11, an electronic gyro/accelerometer 112 can be inserted into the putter head or into an attachment to the putter head to determine the motion of the putter. The sensors (accelerometers and/or electronic gyro, hereinafter just "accelerometer") are currently used in automotive/smartphone/video game applications and are relatively inexpensive. Accelerometers can be used to sense three-axis acceleration and two-axis rotation/pitch/roll. A digital screen display 114 can indicate accuracy of the path. The accelerometer 112 can sense speed and acceleration as well as the putter path, including rotation and tilt of the putter face. Dual accelerometers 112 may be provided to measure, for example, distance of draw back and line to return ball relative to length of putt. The accelerometers 112 detect a swing path, putt speed, head speed, putter face tilt, and putter face rotation. The display 114 may be provided with LEDs to display and show deviations from the preferred path, which may be pre-stored in memory 116 after training and analysis on the systems described in the noted family of patents and applications. Signals from the accelerometer(s) 112 are processed via a processor 117.

The device may include a learn/play option programmed via the processor 116 and an on/off switch (or reset switch) 118. With the learn/play option, if the preferred path is not pre-stored in the system memory 116, the system can learn the preferred path by interactively communicating with the golfer. For example, the system may ask after each putt: Did that putt go in the hole? If not, did it miss right? Left? Was it long? Short? Through an iterative process over many putts, the system can derive the preferred putting path. In an alternative version, if the preferred path is not pre-stored in the system memory 116, the system can use a default path.

There are multiple applications for this technology. For example, the accelerometer(s) 112 can be cooperable with a printed circuit board (PCB) 120 mounted in the putter head or in an attachment to the putter head to record putting strokes during a round of golf. With continued reference to FIGS. 10 and 11, the memory 116 coupled with the PCB 120 can be accessed via a user interface 122 such as a USB port, Bluetooth, hard wire, or the like, where the data can be downloaded to a golfer's computer. The memory 116 can store the preferred putting path and provide an indication of actual putting stroke deviations from the preferred putting path. The deviations can be expressed in terms of degrees, percentages, distance, etc. In addition to the putting path, the system can record and display an angle of the putter face throughout the putting stroke as well as putter face loft. Immediately after performing a putting motion on the putting green, the screen can provide a readout via the display 114 that compares the preferred putting path with the just-completed motion. A degree of correlation can be calculated.

In another application, the system may be cooperable with a smartphone app, where actual putter motion (speed, acceleration, rotation, etc.) is recorded and sent to the smartphone app via Bluetooth, direct link, etc. The smartphone app can display and record all the putting strokes and allow a visual/graphical comparison on the smartphone to the preferred putting path. The PCB 120 may also be cooperable with sensors on the putter to sound an alarm, provide a numerical output, or the like when the golfer deviates from the preferred putting path.

As shown in FIG. 10, an exemplary putter 124 utilizes the handle/grip 126 for battery storage 128 and possibly also a display screen 114. Rechargeable batteries may be preferable to avoid the inconvenience of unscrewing the unit and putting in new batteries. Alternatively, the unit may be capable of using conventional batteries in the event that during play, the rechargeable batteries become discharged. The reset button 118 may also serve as the on/off switch or the learn/play switch as discussed above. The attachment 130 to the putter head incorporating the various sensors may also include a display screen 114 with LEDs that can illuminate to indicate whether the putter head is following the preferred putting path. In FIG. 10, the screen shows also a numerical indicator that may be indicative of the quality of the stroke, deviations from the preferred putting path, etc.

Figure 12:
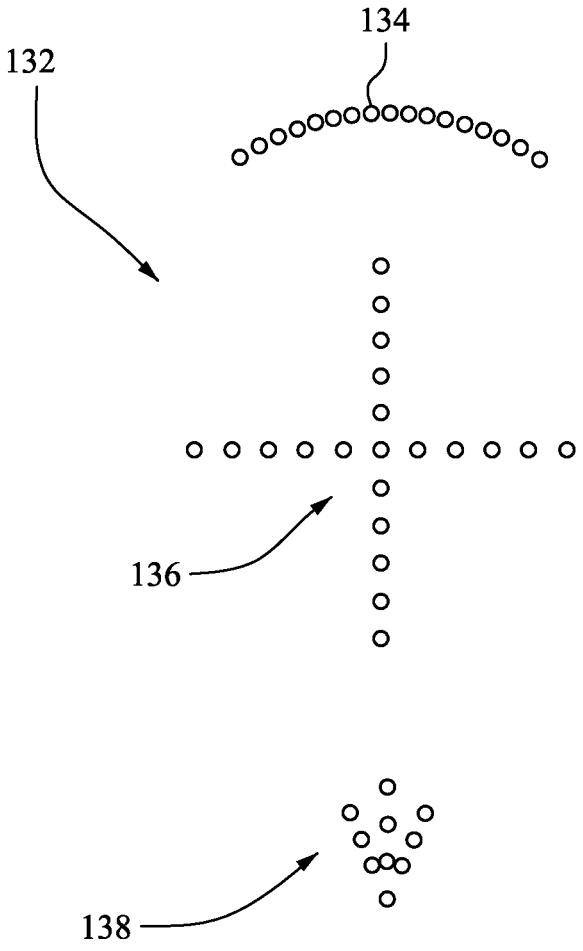
FIG. 12 is an exemplary layout of the LEDs on the system display.

An exemplary configuration of LEDs 132 is shown in FIG. 12. The LEDs can be configured to display in various colors to thereby provide various indications to the golfer. For example, in the front arc row 134 of LEDs, a center portion may include white LEDs for when the club is kept square to the putting direction or is otherwise on the preferred putting path. Yellow LEDs further outside of the center of the arc may indicate that the club has rotated, with a number of yellow LEDs dependent on how much rotation. Red LEDs at the end may illuminate when the club has rotated too much. A second set 136 of LEDs in the middle of the display may be provided for club speed and path indications. White LEDs in the middle can illuminate when the speed and path are good, yellow/red LEDs can illuminate when the putt is too fast or too slow, and still additional yellow/red LEDs can indicate how far the path is deviating from the preferred path. Still another set 138 of LEDs can be provided for club tilt indication with various colors illuminated when the club is level, tilted backward, tilted forward, etc.

Figure 13:
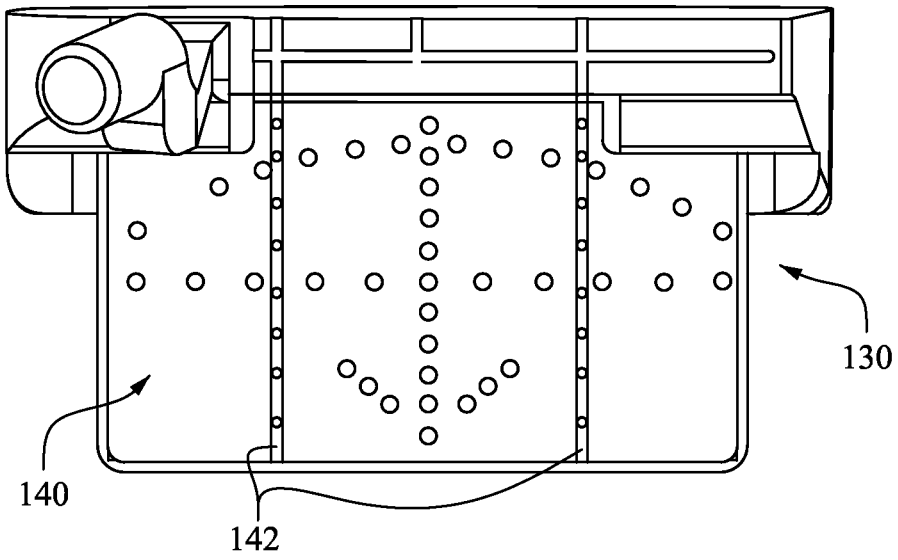
FIG. 13 shows the LEDs on a display attached to the putter.
Figure 14:
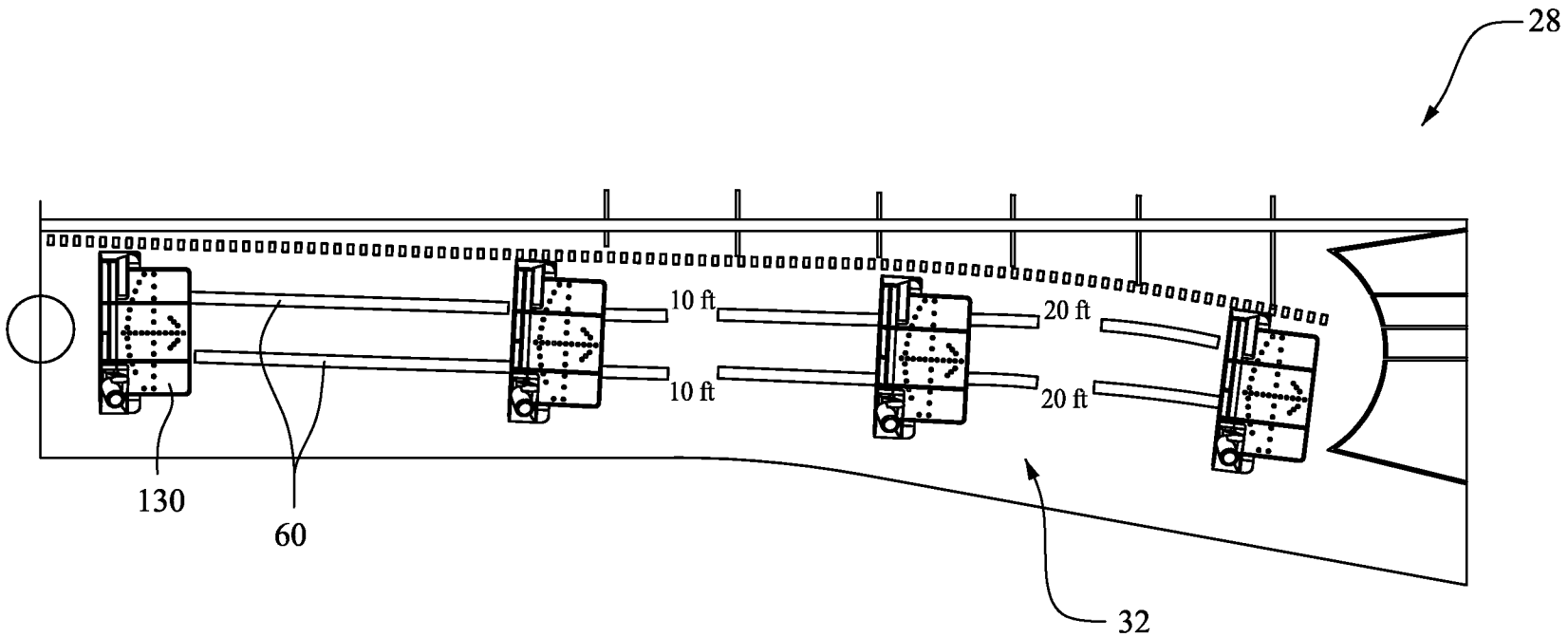
FIG. 14 shows the putter head and sensor unit in use with the grid box training tool.

FIG. 13 is an exemplary view from a golfer's perspective showing the top-facing display 140 of the attachment 130. The LEDs may be arranged to provide in-stroke feedback to the golfer during a putting stroke. In one arrangement, the LEDs may be aligned with alignment lines 142 provided on the attachment as described in the above-noted family of patents and applications. These LEDs can illuminate different colors as the golfer stays on or deviates from the preferred putting path. As shown in FIG. 14, the attachment 130 is also suitable for use with the grid box described above and in the noted family of patents and applications.

It is possible that there will be several modes that can appear on the screen depending on what function or application is called for. Once the aim of the putt has been established, the button on the grip, possibly adjacent a typical thumb position can be pressed to the ON position. This will activate the chip that records the accuracy, speed and distance of the drawback of the club head for each putt. Immediately upon completion of the putt, the recording is visible on the screen. The electronic unit is capable of recording all putting strokes for a round of 18 holes of golf and is able to compare the strokes with the preferred putting path that has been established by the computer through iterations, practice or with a professional golf instructor. As noted, the registrations on the screen can be demonstrated in digital numbers or with lines of different colors. This concept extends beyond the grid box described above and from the above-noted family of patents and applications as all the information would be in the head of the golf club.

Upon completion of a round of golf, the results can be replayed on a laptop or other electronic device.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A putting stroke sensor assembly cooperable with a putter head, the putting stroke sensor assembly comprising:

a processor comprising means for determining a preferred putting path based on successful putts executed by a user, the preferred putting path being unique to the user;

a memory communicating with the processor and storing the preferred putting path; and an accelerometer communicating with the processor, the accelerometer being configured to measure characteristics of a putting stroke, wherein the processor is programmed to compare the characteristics of the putting stroke with the preferred putting path and to generate an output indicative of the comparison.

2. A putting stroke sensor assembly according to claim 1, further comprising a display communicating with the processor, the processor driving the display according to the output.

3. A putting stroke sensor assembly according to claim 2, wherein the display is positioned on a handle attached to the putter head.

4. A putting stroke sensor assembly according to claim 2, wherein the display is positioned on an upward facing surface of the putter head.

5. A putting stroke sensor assembly according to claim 2, wherein the display comprises a plurality of LEDs arranged to convey information about the putting stroke.

6. A putting stroke sensor assembly according to claim 5, wherein a clubface position section of the LEDs includes the LEDs arranged in an arc, and wherein the processor is programmed to cause center ones of the arc to illuminate if the putter face is square to a putting direction at impact, and to cause outer ones of the arc to illuminate if the putter face is rotated relative to the putting direction.

7. A putting stroke sensor assembly according to claim 6, wherein a speed section of the LEDs includes the LEDs arranged in a line in alignment with the putting direction, and wherein the processor is programmed to illuminate different ones of the line depending on a speed of the putter head.

8. A putting stroke sensor assembly according to claim 1, wherein the characteristics of the putting stroke include speed, acceleration, putter head position, putter head path, putter head rotation, and putter head tilt.

9. A putting stroke sensor assembly according to claim 8, comprising a plurality of accelerometers.

10. A putting stroke sensor assembly according to claim 1, wherein the processor is programmed to operate in a learning mode in which the processor interactively communicates with the user to measure the preferred putting path.

11. A putting stroke sensor assembly according to claim 1, further comprising a user interface in communication with the processor.

12. A method for analyzing a putting stroke using a stroke sensor assembly including a processor, a memory communicating with the processor, and an accelerometer, the method comprising:

determining a preferred putting path based on successful putts executed by a user, the preferred putting path being unique to the user, and storing the preferred putting path in the memory;

measuring characteristics of a putting stroke with the accelerometer;

comparing, with the processor, the characteristics of the putting stroke with the preferred putting path; and generating an output indicative of the comparison.

13. A method according to claim 12, wherein the determining step is practiced by interactively communicating with the user to measure the preferred putting path.

14. A method according to claim 12, further comprising displaying an image that represents the output.

15. A method according to claim 14, wherein the displaying step comprises displaying the image on a handle attached to the putter head.

16. A method according to claim 14, wherein the displaying step comprises displaying the image on an upward facing surface of the putter head.

17. A method according to claim 12, wherein the measuring step comprises measuring speed, acceleration, putter head position, putter head path, putter head rotation, and putter head tilt.

18. A method according to claim 12, wherein the measuring step is practiced for each putt during a round of golf, and wherein the comparing step comprises comparing each putting stroke in the round of golf with the preferred putting path.

19. A putting stroke sensor assembly cooperable with a putter head, the putting stroke sensor assembly comprising:

a processor;

a memory communicating with the processor; and an accelerometer communicating with the processor, the accelerometer being configured to measure characteristics of a putting stroke, wherein the processor is programmed to operate in a learning mode in which the processor interactively communicates with a user to measure a preferred putting path that is unique to the user based on successful putts executed by the user, the memory storing the preferred putting path, and wherein the processor is further programmed to compare the characteristics of the putting stroke with the preferred putting path and to generate an output indicative of the comparison.

20. A putting stroke sensor assembly according to claim 19, further comprising a display communicating with the processor, the processor driving the display according to the output, wherein the display is positioned on at least one of a handle attached to the putter head and on an upward facing surface of the putter head.

* * * * *